United States Patent [19]

Lee

[11] 4,355,676

[45] Oct. 26, 1982

[54] MOVABLE GLAZING AND INSULATION FOR WINDOWS

[76] Inventor: Kenneth S. Lee, 1711 Palomar, Ann Arbor, Mich. 48103

[21] Appl. No.: 240,925

[22] Filed: Mar. 5, 1981

[51] Int. Cl.[3] ..... A47H 1/00; E06B 3/32

[52] U.S. Cl. ..... 160/107; 49/62

[58] Field of Search ..... 160/89, 90, 96, 107, 160/129, 189, 231 A; 49/51, 56, 61, 62, 63, 64, 147, 397

[56] References Cited

U.S. PATENT DOCUMENTS

| | | | |
|---|---|---|---|
| 2,689,387 | 9/1954 | Carr | 49/62 |
| 2,914,122 | 11/1959 | Pinto | 160/89 |
| 3,060,832 | 10/1962 | Wright et al. | 49/147 |
| 3,314,551 | 4/1967 | Plastow | 160/231 A |
| 3,642,557 | 2/1972 | Warp | 52/788 |
| 4,292,763 | 10/1981 | Barnes et al. | 49/64 |

*Primary Examiner*—Peter M. Caun
*Attorney, Agent, or Firm*—James M. Deimen

[57] ABSTRACT

The invention comprises a double glazing construction having foldable insulating louvers attached to and located between the glazing panels. The louvers include internal insulating means and dual hingeing means permitting the louvers to be closed and opened as one of the glazing panels is moved relative to the other. The specific configuration of the louvers and the means for attaching the louvers to the glazing permit the louvers, the hingeing means and the glazing to be manufactured from extruded plastic components. The louvers may be coated with a heat and light reflective material to further improve the insulating effectiveness when the louvers are closed and to direct sunlight deeper within a building interior when the louvers are opened.

24 Claims, 9 Drawing Figures

MOVABLE GLAZING AND INSULATION FOR WINDOWS

BACKGROUND OF THE INVENTION

The field of the invention pertains to windows for buildings and in particular to means for controlling the passage of sunlight through windows and means for improving the resistance to heat flow through windows.

Double glazing is a common construction technique for improving the resistance of windows to the transfer of heat therethrough. The panes of glazing, commonly glass or plastic, are typically separated by an air gap of one quarter of an inch to one inch. The double glazing may be provided by separate storm windows or by permanently installed double panes. To provide additional insulation a third pane of glazing separated by a second air gap may be added. Heavy drapes, movable insulating blankets or louvers may be positioned adjacent the glazing on the inside of the structure. Such techniques are commonly employed for windows regardless of the compass direction the windows face.

Movable louvers may be positioned against skylights to control the heat and light gain. However, the other techniques noted above are not practical for skylights. The devices above control heat gain and light transmission into the immediate interior area adjacent the window or skylight but do not necessarily take advantage of the compass direction the window or skylight faces.

Examples of insulated movable louvers to control light and heat flow through glazing are the "SUN MOVER," Solar Technology Corporation, Denver, Colo. and the "SKYLID," Zomeworks Corp., Albuquerque, N. Mex. These devices comprise pivotably mounted louvers positioned inside the glazing of the window or skylight.

SUMMARY OF THE INVENTION

The invention comprises a double glazing construction having foldable insulating louvers attached to and located between the glazing panels. The louvers are positioned horizontally for south facing windows and vertically for east and west facing windows. The louvers include internal insulating means and dual hingeing means permitting the louvers to be closed and opened as one of the glazing panels is moved relative to the other. Typically, the interior pane of glazing is moved relative to a permanently affixed exterior pane.

The panes include either integral extruded channels or separate extruded channels affixed to the panes in opposed relationship between the panes. Extruded louvers including integral hinges are inserted into the channels. The louvers are opened or closed by moving the interior pane of glazing relative to the exterior pane.

The extruded louvers are formed with a double wall creating an internal insulating air space therein. Alternatively, the air space may be filled with insulating foam. When the louvers are closed the combination with the exterior and interior glazing panes creates triple insulating air spaces between the exterior and interior panes. The exterior surfaces of the louvers are covered with a heat and light reflective coating to further enhance the insulating effectiveness of the louvers when shut. The heat and light reflective coating on the louvers enables incoming sunlight and heat to be redirected inside the building interior for an improved distribution of natural lighting and heat gain. To achieve the improved light and heat distribution, south facing windows are equipped with horizontal louvers and east and west facing windows are equipped with vertical louvers.

The particular design of the louvers including the hingeing means permits extrusion from very inexpensive plastic materials and fabrication techniques of sufficient simplicity to permit the sale of kits for retrofitting existing windows by relatively unskilled persons.

DESCRIPTION OF THE PREFERRED EMBODIMENTS

Figure 1:
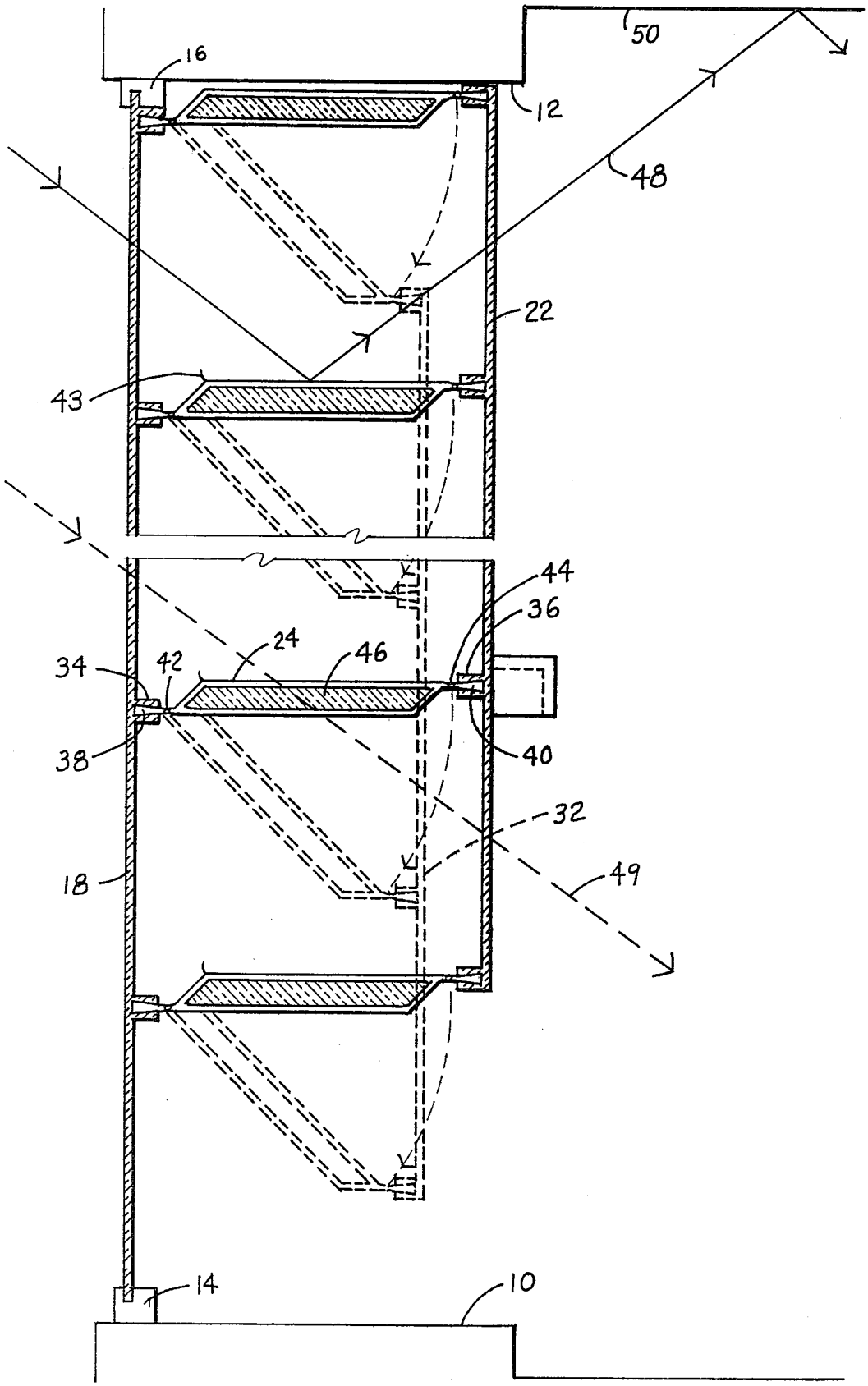
FIG. 1 is a vertical cross-section of a south facing window according to the invention.

In FIG. 1 a typical vertical cross-section of a south facing window embodying the invention is illustrated. The window assembly is positioned between a lower sill 10 and upper sill 12 with window lower frame member 14 and upper frame member 16 attached thereto respectively. An exterior stationary glazing pane 18 is inserted into slots 20 in the upper and lower frame members 14 and 16. Spaced from the exterior pane 18 is a movable glazing pane 22 that is supported by a plurality of horizontal louvers 24.

Figure 2:
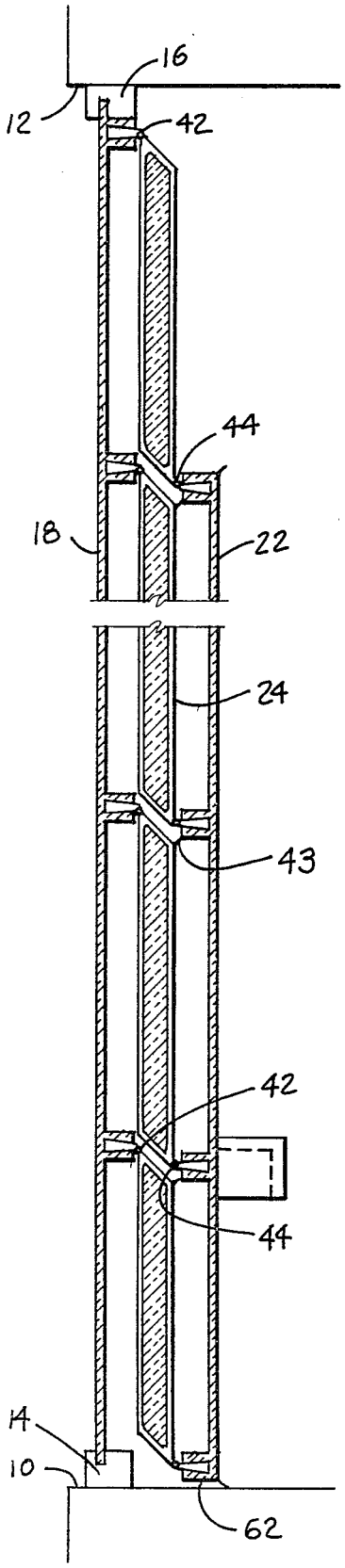
FIG. 2 is a vertical cross-section of the window of FIG. 1 in closed insulating position.

As shown in FIG. 1 the louvers 24 are fully open to permit the passage of light through the window as well as maximum direct heat gain to the interior of the structure. In FIG. 2 the louvers 24 and movable glazing 22 are shown in the fully closed position preventing the passage of light therethrough and completely covering the exterior glazing 18.

Figure 7:
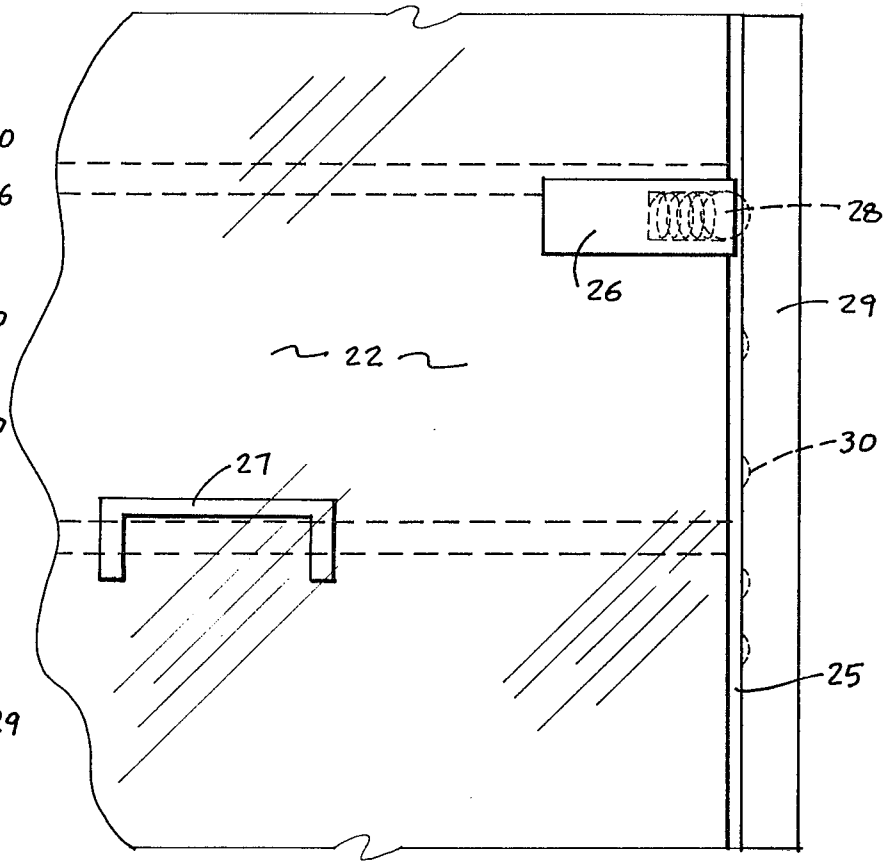
FIG. 7 is a cutaway view of the window and the latching means.
Figure 6:
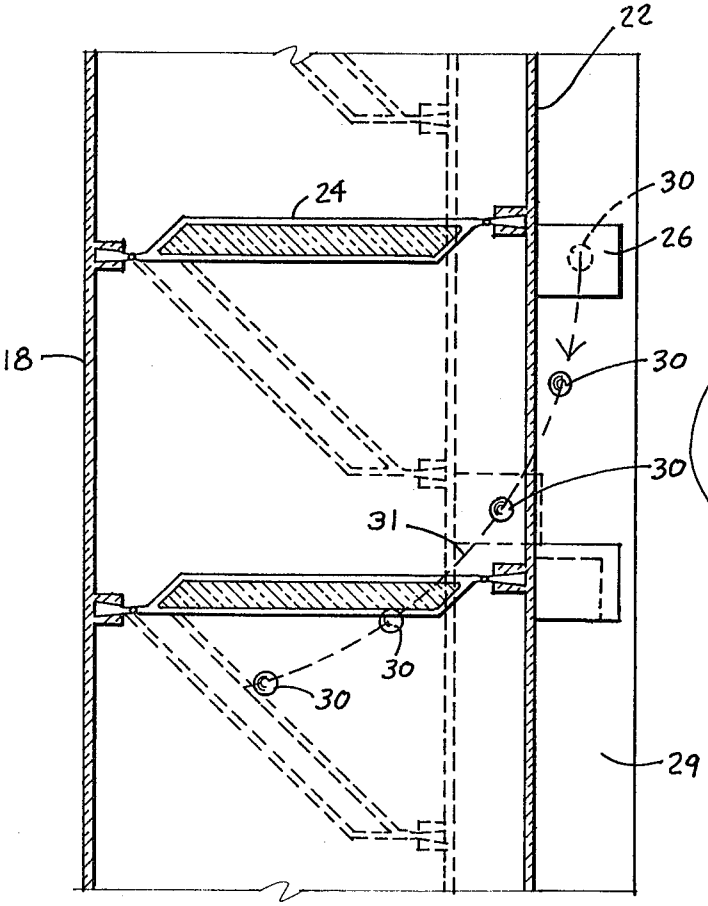
FIG. 6 is a partial cross section view of the window and latching means for the window.

Referring to FIGS. 6 and 7 a latch mechanism 26 comprising a ball detent 28 is attached to the movable pane 22 at the edge of the pane. The ball detent 28 is adapted to engage any one of a plurality of sockets 30 spaced along an arcuate path 31 in the window jamb 29. The movable pane 22 and louvers may be opened, closed or set in an intermediate position by grasping the handle 27 and moving the movable pane 22 to the desired ball detent socket 30. A piece of weatherstrip 25 is adhesively attached to the pane 22 to provide a movable sliding seal with the jamb 29.

Opposed dovetail channel mullions 34 and 36 extend from the exterior glazing 18 and the movable interior glazing 22. Inserted in the channel mullions 34 and 36 are dovetail tongues 38 and 40. The tongues 38 and 40 form integral longitudinal edges of the louvers 24. The dovetail tongues 38 and 40 are attached to the central portion of the louver 24 by continuous hinges 42 and 44.

The central portion of the louver 24 is filled with insulating foam 46. Optionally, the louver 24 can be left hollow to provide an insulating air gap between the walls of the louver. Thus, either triple air gaps or double air gaps separated by an insulated louver are provided between the double glazing.

The exterior surfaces of the louvers 24 may be coated or covered with a heat and light reflective material. The coating produces additional resistance to the transmission of heat when the louvers 24 are closed. When the louvers 24 are open, the light, in particular, as shown by the arrow 48 can be reflected off the louvers and off the interior ceiling 50 to provide increased daylighting to the interior of the building.

With the louvers 24 set in an intermediate position such as that shown ghosted at 32 in FIG. 1, light and heat (arrow 49) can be directed toward the floor adjacent the window. Thus, the heat and light gain to the building interior can be selectively controlled by adjusting the angular position of the louvers.

Figure 4:
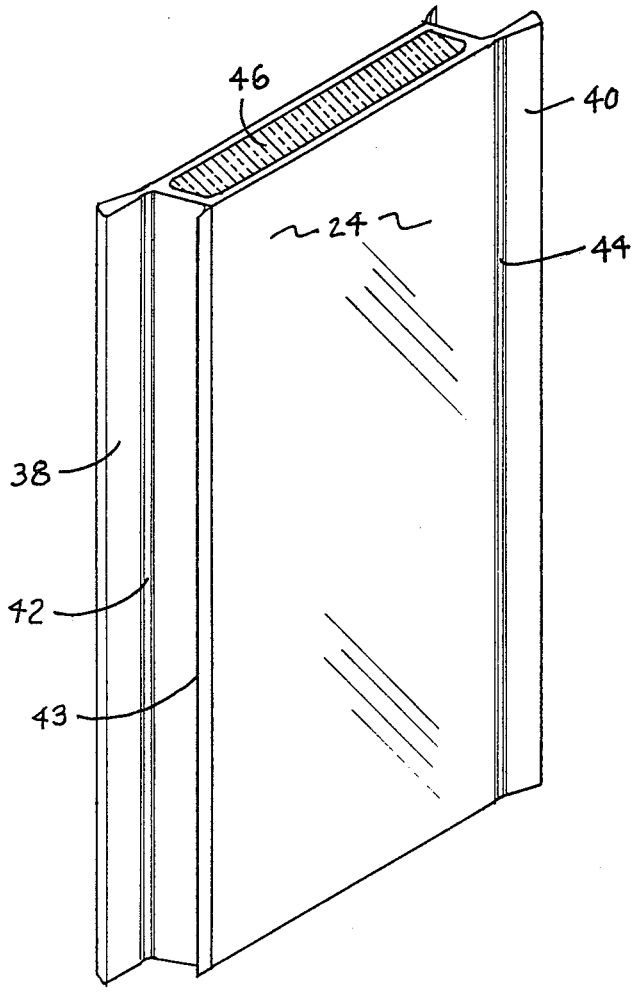
FIG. 4 is a partial perspective view of one of the insulating louvers for the windows.

The louvers are preferably formed by extruding a suitable plastic material such as polyethylene, polypropylene or other material suitable for extrusion. In FIG. 4 the tongues 38 and 40 and hinges 42 and 44 are preferably formed as an integral flexible part of the extrusion. The use of a material such as polypropylene is suitable for such an integral flexible "living" hinge. Alternatively, mechanical hinges such as piano hinges might be substituted where the material of the louver 24 is not suitable for a flexible extruded "living" hinge. A urethane foam or other foam insulation is expanded inside the louver and the exterior coated with a suitable reflective material. Alternatively, aluminum foil may be adhered to the louver exterior.

The exterior glazing 18 and movable glazing 22 may be formed from extruded clear or translucent plastic with the dovetail mullions 34 and 36 formed as integral parts thereof. Alternatively, the glazing 18 and 22 may be formed of flat plate glass or plastic and the dovetail mullions 34 and 36 formed by extrusion and adhesively fastened to the glazing.

The extruded construction of the louvers and mullions permits the window structure to be manufactured very economically. The extrusions need only be cut to the proper length and then assembled by snapping or sliding the dovetail mullions and tongues together.

Figure 8:
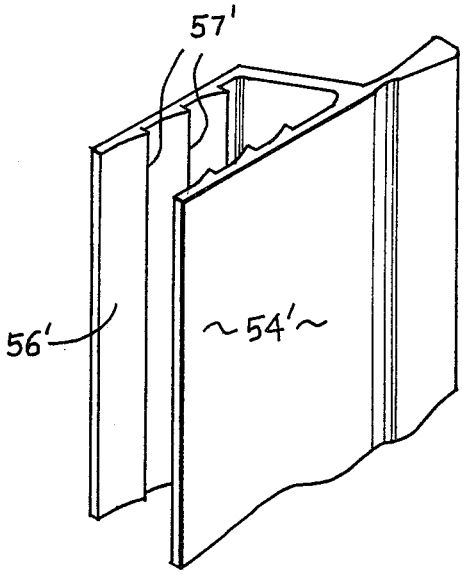
FIG. 8 is a cutaway view of an attachment modification for the alternative embodiment of FIG. 5; and, FIG. 9 is a cross-section of the window modified for use as a skylight.
Figure 5:
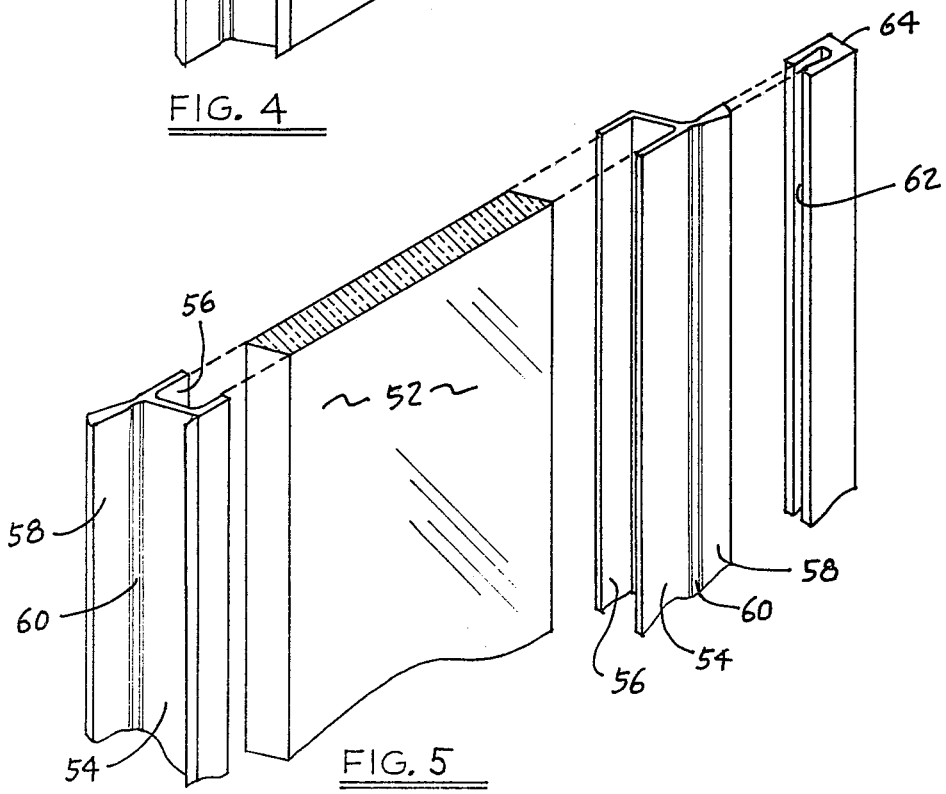
FIG. 5 is a partial perspective view of an alternative construction for the insulating louver of FIG. 4.

FIG. 5 illustrates an alternative construction for the louvers 24. The central portion 52 of the louver is formed from rigid foam insulation sheet that is covered on one or both sides with a heat and light reflective material. Such rigid foam insulation is available in one half inch and other thicknesses in retail building supply stores. The insulation is cut into strips of required width and length for the particular window installation. Attached to the rigid foam 52 are a pair of extruded hinge and attachment strips 54. The strips may be extruded from polyethylene or polypropylene. The strips include a U-section 56 that engages the rigid foam 52 and a dovetail tongue 58 joined to the U-section 56 by the integral hinge 60. The tongue 58 is engageable with dovetail channel mullion 62 also preferably formed by plastic extrusion. The back 64 of the extruded mullion 62 is adhesively fastened to the glazing (not shown). The U-section 56 may be adhesively attached to the central portion 52 or as shown in FIG. 8 the U-section 56' of the strip 54' may be serrated or grooved 57' to prevent extraction of the central portion 52 after insertion into the U-section.

Returning to FIG. 2 the louvers in the closed position nest together with the lower end 64 of the movable glazing pane 22 adjacent the lower frame 14. The integral flexible hinges 42 and 44 and a thin weatherstrip 43 effectively prevent the circulation of air through the louvers or vertically between the louvers and the exterior glazing 18. The weatherstrip 43 is formed as a thin flap integral with the louver 24 in the extrusion process.

Figure 3:
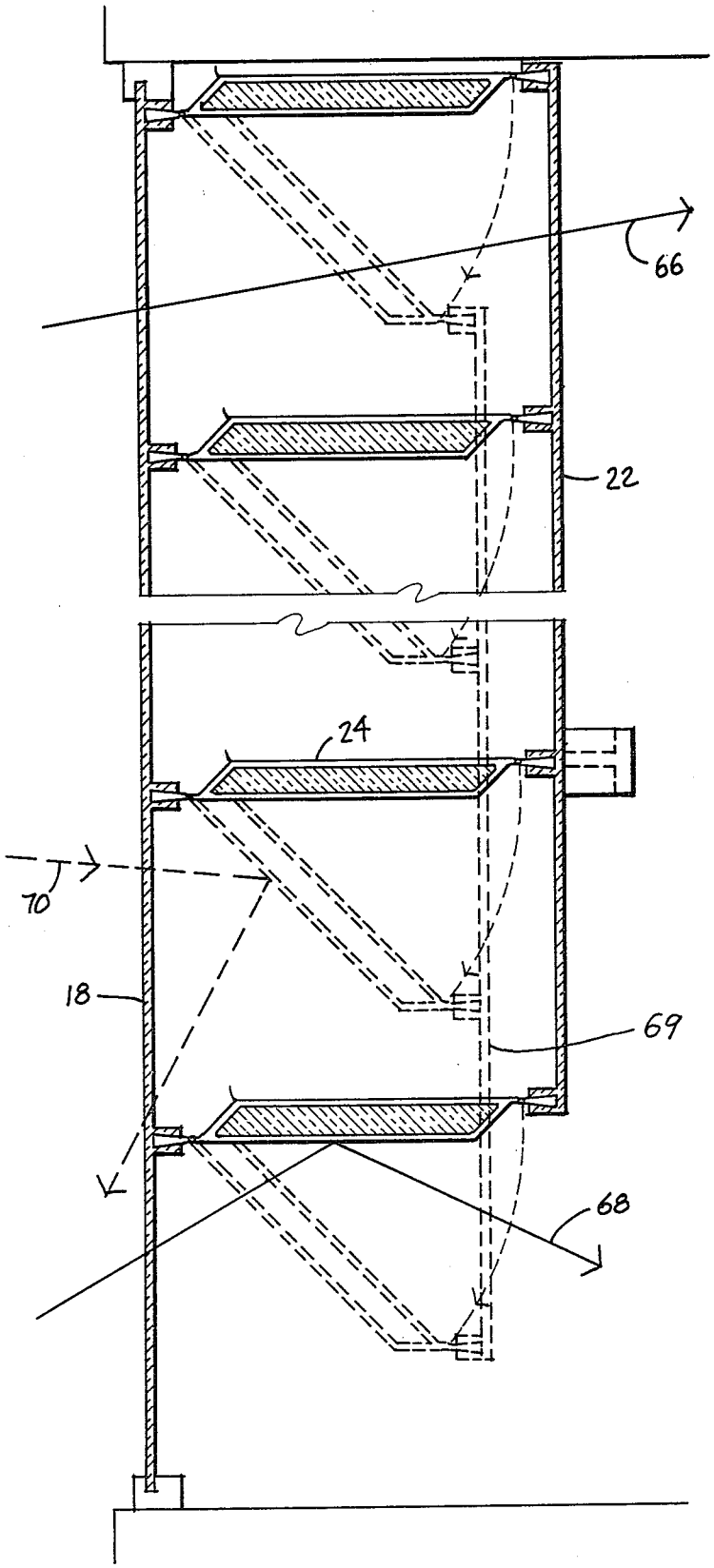
FIG. 3 is a cross-section of the window installed in an east or west facing position.

FIG. 3 illustrates the use of the movable glazing and louvers in an east or west facing window. The basic construction of the window assembly is similar to that shown for the south facing window, however, the orientation of the louvers is vertical. With the louvers 24 fully open there can be mostly direct gain of heat and light as shown by arrow 66 or mostly indirect heat and light gain as shown by arrow 68 depending on the time of day and specific orientation of the window. By adjusting the position of the louvers to an intermediate location such as that shown in dashed outline 69 a portion of the light and heat (arrow 70) can be reflected back out through the exterior glazing 18. The light and heat gain can be thereby controlled and adjusted as the sun moves during the day.

The vertical louver orientation also can be installed in south facing windows rather than the horizontal louver orientation. The vertical orientation may be preferred where it is desired to follow the sun as it moves from east to west during the day rather than to follow the sun as it rises and falls during the day.

Figure 9:
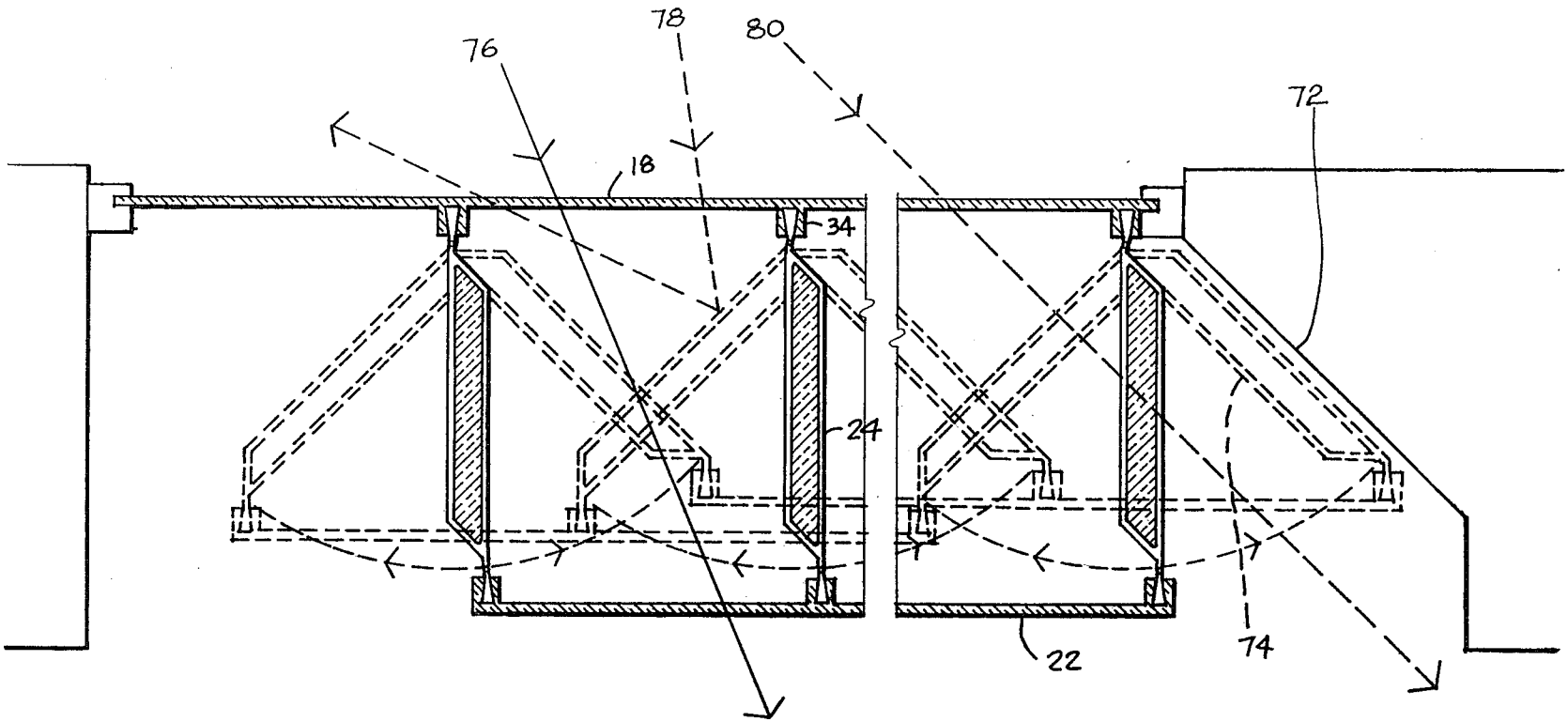

In FIG. 9 the movable glazing and louvers are shown in a skylight installation. Again the basic construction of the assembly is similar to that shown above, however, the louvers 24 and interior glazing 22 are suspended from the glazing 18 and mullions 34. With this configuration interior glazing 22 of plastic is to be preferred over heavy glass. The louvers 24 are opened and closed fully as above, however, the supporting ceiling structure 72 is tapered back permitting the louvers 24 to be rotated beyond the fully open position to the position shown ghosted at 74. A greater range of adjustment to accommodate the direction of the sun light is thereby provided for the skylight as illustrated by the arrows 76, 78 and 80. Arrow 76 indicates sunlight and heat passing through the normal full open position of the louvers and arrow 78 indicates the reflection of sunlight and heat from the partially closed position of the louvers as above. Arrow 80 indicates the extended open position to allow direct heat and sunlight gain despite a low sun angle to the skylight. The configuration permits a wide range of adjustment for direct gain, indirect gain or reflection despite the low altitude of the sun in the winter sky. To retain the louvers in the extended open position additional ball detents are added in an extended arcuate path in the skylight frame for the additional range. The range of adjustment for the vertical louver window illustrated in FIG. 3 can also be extended by tapering back the window jamb in the same manner.

The embodiments of the louvered window or skylight are particularly suitable for green houses with sloping or flat roofs in addition to other structures with windows in sloping or flat roofs as well as the walls. The low cost manufacture of the louvers, mullions and glazing by extrusion renders the invention of particular advantage for green houses with great expanses of glazing.

I claim:

1. A window assembly comprising an exterior glazing pane, an interior glazing pane spaced from said exterior pane and movable relative to said exterior pane, a plurality of louvers positioned between said exterior pane and said interior pane, a plurality of opposed parallel mullions extending from said exterior and interior panes, said mullions being parallel with said louvers, said louvers being longitudinally attached to pairs of said opposed parallel mullions and including longitudinal hinge means to permit the movement of the interior pane relative to the exterior pane.

2. The window assembly of claim 1 wherein the hinge means comprise hinges located adjacent the attachment to the mullions.

3. The window assembly of claim 1 wherein said louvers include hollow central portions bounded on both longitudinal edges by said hinge means.

4. The window assembly of claim 1 wherein said mullions engage tongues comprising the longitudinal edges of said louvers.

5. The window assembly of claim 4 wherein integral flexible hinge means join the longitudinal tongues to the central portions of the louvers.

6. The window assembly of claim 5 wherein the central portions of said louvers include insulating foam.

7. The window assembly of claims 4 or 5 wherein said mullions and tongues comprise complementary dovetail channels and tongues.

8. The window assembly of claims 4 or 5 wherein said mullions extend integrally from at least one of said panes.

9. The window assembly of claims 4 or 5 wherein said mullions are adhesively attached to at least one of said panes.

10. The window assembly of claims 4 or 5 wherein at least one side of said louvers includes a heat and light reflective surface.

11. The window assembly of claim 1 including means to retain said louvers in any one of a plurality of positions from fully open to fully closed.

12. A louver for use with a window or skylight comprising a generally longitudinal central portion, slideable longitudinal attachment means and hinge means, said hinge means joining said longitudinal attachment means to the central portion, and said slideable attachment means comprising an extruded section adapted for slideable assembly or disassembly with complementary longitudinal attachment mean to form a continuous air tight seal.

13. The louver of claim 12 wherein said hinge means comprises an integral flexible narrow section joining the attachment means longitudinally to the central portion.

14. The louver of claim 12 wherein said attachment means and hinge means comprise longitudinal dovetail tongues extending integrally and flexibly from opposite longitudinal edges of the central portion.

15. The louver of claim 14 wherein the central portion is hollow.

16. The louver of claim 14 wherein the central portion includes insulating foam.

17. The louver of claims 14, 15 or 16 wherein at least one side of said central portion is surfaced with a heat and light reflective means.

18. The louver of claim 14 including dovetail channel mullions engageable with said dovetail tongues.

19. The louver of claim 12 including mullions engageable with said longitudinal attachment means.

20. The louver of claim 12 wherein said central portion comprises rigid insulating foam, said rigid insulating foam being affixed to a pair of said hinge and attachment means.

21. The louver of claim 20 wherein each of said hinge and attachment means comprise an integral flexible hinge, means affixing said hinge to said rigid insulating foam and means adapted for engagement with a mullion.

22. The window assembly of claim 21 wherein said means affixing said hinge to said rigid insulating foam comprises a U-section having serrated means adapted to grip the foam upon insertion therein.

23. The window assembly of claim 4 wherein the mullions space the louvers from the panes to provide air gaps between the louvers and the panes in the closed position.

24. A window assembly comprising a glazing pane, a plurality of parallel louvers, each of said louvers having at least one longitudinal hinge extending the length of the louver, a first plurality of mullions parallel to said louvers and extending from said pane, said mullions longitudinally engageable with said louvers, a second plurality of parallel mullions longitudinally engageable with said louvers opposite said first plurality of mullions, said second plurality of mullions including means for affixation to a second glazing pane.

* * * * *